US012060144B1

(12) United States Patent
Novak et al.

(10) Patent No.: US 12,060,144 B1
(45) Date of Patent: Aug. 13, 2024

(54) STOWABLE PROPULSION DEVICES FOR MARINE VESSELS AND METHODS FOR MAKING STOWABLE PROPULSION DEVICES FOR MARINE VESSELS

(71) Applicant: Brunswick Corporation, Mettawa, IL (US)

(72) Inventors: Aaron J. Novak, North Fond du Lac, WI (US); Jeremy J. Kraus, Mt Calvary, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/531,314

(22) Filed: Dec. 6, 2023

Related U.S. Application Data

(63) Continuation of application No. 17/388,850, filed on Jul. 29, 2021, now Pat. No. 11,873,071, which is a (Continued)

(51) Int. Cl.
*B63H 21/30* (2006.01)
*B63H 20/10* (2006.01)
*B63H 20/00* (2006.01)

(52) U.S. Cl.
CPC ..... *B63H 21/30* (2013.01); *B63H 20/10* (2013.01); *B63H 20/007* (2013.01)

(58) Field of Classification Search
CPC . B63H 5/125; B63H 20/02; B63H 2005/1256
See application file for complete search history.

(56) References Cited

U.S. PATENT DOCUMENTS 2,213,520 A 9/1940 Gentry
3,462,102 A 8/1969 Rivers
(Continued)

FOREIGN PATENT DOCUMENTS

EP 1611007 8/2007
EP 1914161 4/2008
(Continued)

OTHER PUBLICATIONS

International Search Report and Written Opinion for International Application No. PCT/CA/2016/050308 mailed Jun. 9, 2016.
(Continued)

*Primary Examiner* — Andrew Polay
(74) *Attorney, Agent, or Firm* — Andrus Intellectual Property Law, LLP

(57) ABSTRACT

A stowable propulsion device for a marine vessel having a deck. A base is configured to be coupled to the marine vessel below the deck. A propulsor is configured to propel the marine vessel in water. An arm couples the propulsor to the base such that moving the arm moves the propulsor into and between a stowed position located proximate to the marine vessel and a deployed position located relatively distal from the marine vessel as compared to the stowed position, and such that moving the arm rotates the propulsor about the arm. An actuator comprises a first link movably coupled to the base and a second link that movably couples the first link to the arm. An actuator moves the actuator linkage to thereby move the propulsor into and between the stowed position and the deployed position.

20 Claims, 7 Drawing Sheets

Related U.S. Application Data continuation-in-part of application No. 17/185,289, filed on Feb. 25, 2021, now Pat. No. 11,572,146.

(56) References Cited

U.S. PATENT DOCUMENTS

| | | | | |
|---|---|---|---|---|
| 3,809,343 | A | 5/1974 | Adams et al. | |
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,548,586 | A | 10/1985 | Philips | |
| 4,734,068 | A | 3/1988 | Edwards | |
| 4,875,656 | A | 10/1989 | Boede | |
| 4,911,398 | A | 3/1990 | Diiulio et al. | |
| 4,966,566 | A | 10/1990 | Baird | |
| 5,005,798 | A | 4/1991 | Mccoy | |
| 5,022,609 | A | 6/1991 | Cranston | |
| 5,131,875 | A | 7/1992 | Lee | |
| 5,152,240 | A * | 10/1992 | Fontanille | B63H 25/42 114/151 |
| 5,195,914 | A | 3/1993 | Binversie et al. | |
| 5,277,630 | A | 1/1994 | Clark | |
| 5,499,792 | A | 3/1996 | Tamiso | |
| 5,639,272 | A | 6/1997 | Henderson et al. | |
| 5,669,794 | A | 9/1997 | Knight et al. | |
| 5,941,742 | A | 8/1999 | Whitaker | |
| 6,142,841 | A | 11/2000 | Alexander, Jr. et al. | |
| 6,280,267 | B1 * | 8/2001 | Griffith, Sr. | B63H 20/10 440/6 |
| 6,325,685 | B1 | 12/2001 | Knight et al. | |
| 6,431,923 | B1 | 8/2002 | Knight et al. | |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 | 12/2006 | Janitz | |
| 7,285,029 | B1 | 10/2007 | Janitz | |
| 7,294,029 | B1 | 11/2007 | Spaulding | |
| 7,305,928 | B2 | 12/2007 | Bradley et al. | |
| 7,399,211 | B1 | 7/2008 | Spaulding | |
| 7,510,450 | B1 | 3/2009 | Dresher | |
| 7,520,239 | B2 | 4/2009 | Bryham | |
| 7,753,745 | B2 | 7/2010 | Schey et al. | |
| 7,887,381 | B2 | 2/2011 | Brass et al. | |
| 7,946,243 | B1 | 5/2011 | Ulrich | |
| 8,011,982 | B1 | 9/2011 | Baier et al. | |
| 8,051,793 | B2 | 11/2011 | Ulgen | |
| 8,479,677 | B2 | 7/2013 | Bolline et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 | 2/2018 | Ostrowsky | |
| 9,896,162 | B2 | 2/2018 | Mcclure | |
| 9,969,474 | B1 | 5/2018 | Traux et al. | |
| 10,167,069 | B2 | 1/2019 | Houle et al. | |
| 10,220,926 | B1 | 3/2019 | Pelini | |
| 10,850,820 | B1 | 12/2020 | Minogue | |
| 11,591,057 | B2 | 2/2023 | Tornbaum et al. | |
| 11,603,179 | B2 | 3/2023 | Poirier et al. | |
| 11,801,926 | B2 | 10/2023 | Kraus et al. | |
| 2002/0142680 | A1 | 10/2002 | Anderson | |
| 2007/0232159 | A1 | 10/2007 | Lee | |
| 2009/0227158 | A1 | 9/2009 | Bernloehr et al. | |
| 2010/0032545 | A1 | 2/2010 | Bernloehr et al. | |
| 2010/0116967 | A1 | 5/2010 | Todd et al. | |
| 2010/0136857 | A1 | 6/2010 | Goudsmit | |
| 2016/0001865 | A1 | 1/2016 | Bernloehr et al. | |
| 2017/0341718 | A1 | 11/2017 | Zimmerman | |
| 2018/0057130 | A1 * | 3/2018 | Houle | B63H 5/20 |
| 2018/0334233 | A1 | 11/2018 | Vance, Jr. | |

FOREIGN PATENT DOCUMENTS

| | | | |
|---|---|---|---|
| EP | 2757037 | 7/2014 | |
| EP | 2242678 | 11/2015 | |
| EP | 2246252 | 5/2019 | |
| JP | 2013100013 | 5/2013 | |
| WO | WO-2020187991 A1 * | 9/2020 | B63H 1/14 |

OTHER PUBLICATIONS

Unpublished U.S. Appl. No. 17/377,061, filed Jul. 15, 2021 by Andres Perdomo Tornbaum.
Unpublished U.S. Appl. No. 17/378,383, filed Jul. 16, 2021 by Andres Perdomo Tornbaum.
Unpublished U.S. Appl. No. 17/379,435, filed Jul. 19, 2021 by Andres Perdomo Tornbaum.
Unpublished U.S. Appl. No. 17/388,850, filed Jul. 29, 2021 by Jeremy J. Kraus.
Unpublished U.S. Appl. No. 17/553,245, filed Dec. 16, 2021 by Jeremy J. Kraus.
Unpublished U.S. Appl. No. 29/823,128, filed Jan. 14, 2022 by Matthew Z. Seta.
Unpublished U.S. Appl. No. 18/091,062, filed Dec. 29, 2022 by Jeremy J. Kraus.
Unpublished U.S. Appl. No. 18/099,784, filed Jan. 20, 2023 by Jim Erickson.

* cited by examiner

STOWABLE PROPULSION DEVICES FOR MARINE VESSELS AND METHODS FOR MAKING STOWABLE PROPULSION DEVICES FOR MARINE VESSELS

CROSS REFERENCE TO RELATED APPLICATION

This application is a continuation of U.S. patent application Ser. No. 17/388,850, filed Jul. 29, 2021, which claims benefit of continuation-in-part of U.S. patent application Ser. No. 17/185,289, filed Feb. 25, 2021, both of which are incorporated by reference herein in their entireties.

FIELD

The present disclosure generally relates to stowable propulsors for marine vessels.

BACKGROUND

The following U.S. Patents provide background information and are incorporated by reference in entirety.

U.S. Pat. No. 6,142,841 discloses a maneuvering control system that utilizes pressurized liquid at three or more positions of a marine vessel to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor. The docking system comprises a plurality of the propulsion assemblies. Each propulsion assembly includes a motor and propeller assembly provided on the distal end of a steering column. Each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion system. An example indicator includes a light operatively coupled to a propulsion system of a watercraft, wherein an operation of the light indicates a status of a thruster system of the propulsion system.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a stowable propulsion device for a marine vessel. A base is configured to be coupled to the marine vessel. A propulsor is configured to propel the marine vessel in water. An arm pivotably couples the propulsor to the base to move the propulsor into and between a stowed position located proximate to the marine vessel and a deployed position located relatively distal from the marine vessel as compared to the stowed position. An actuator linkage includes a first link that is pivotably coupled to the base and a second link that pivotably couples the first link to the arm. An actuator pivots the actuator linkage to move the propulsor into and between the stowed position and the deployed position.

Another embodiment generally relates to a method for making a stowable propulsion device for a marine vessel. The method includes configuring a base for coupling to the marine vessel and providing a propulsor configured to propel the marine vessel in water. The method further includes pivotally coupling the propulsor to the base via an arm such that the propulsor is movable into and between a stowed position located proximate to the marine vessel and a deployed position located relatively distal from the marine vessel as compared to the stowed position. The method further includes pivotally coupling a first link to the base and pivotally coupling the first link to the arm via a second link, where the first link and the second link form an actuator linkage. The method further includes providing an actuator that pivots the actuator linkage so as to move the propulsor into and between the stowed position and the deployed position.

Another embodiment generally relates to a stowable propulsion device for a marine vessel. A base is configured to be coupled to the marine vessel and a propulsor is configured to propel the marine vessel in water. An arm pivotably couples the propulsor to the base to move the propulsor into and between a stowed position located proximate to the marine vessel and a deployed position located relatively distal from the marine vessel as compared to the stowed position. An actuator linkage includes a first link pivotably coupled to the base and a second link pivotably coupling the first link to the arm. An actuator pivots the actuator linkage to move the propulsor into and between the stowed position and the deployed position. A stop member limits pivoting of the first link relative to the second link, where an angle between the first link and the second link is greater than 180 degrees and less than 210 degrees when the propulsor is in the deployed position, and where the angle is less than 90 degrees when the propulsor is in the stowed position. The actuator is pivotably coupled to the base at a first pivot axis and pivotably coupled to the first link at a second pivot axis. The first link is pivotably coupled to the base at a third pivot axis and pivotably coupled to the second link at a fourth pivot axis. The second link is pivotably coupled to the arm at a fifth pivot axis. The arm is pivotally coupled to the base at a sixth pivot axis. The second pivot axis is horizontally closer to the sixth pivot axis when the propulsor is in the deployed position than when the propulsor is in the stowed position. The propulsor is closer to the fifth pivot axis than to the sixth pivot axis. The fourth pivot axis is horizontally closer than the fifth pivot axis to the sixth pivot axis when in the stowed position. The fifth pivot axis is horizontally closer than the fourth pivot axis to the sixth pivot axis when in the deployed position. The fifth pivot axis remains vertically below the fourth pivot axis while pivoting between the stowed and deployed positions. The third pivot axis is vertically above the fourth pivot axis when the propulsor is in the deployed position. The fourth pivot axis is vertically above the third pivot axis when the propulsor is in the stowed position.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Through experimentation and development, the present inventors have recognized a problem for bow thrusters designed to be retractable for storage. Specifically, actuators used to pivot the arm supporting the propulsor experience high levels of strain and, consequently, have poor durability and reliability. Additionally, the inventors have recognized that log strikes or other impacts on the propulsor (or arm) are directly transferred to the actuator, which can cause catastrophic failure.

Figure 1:
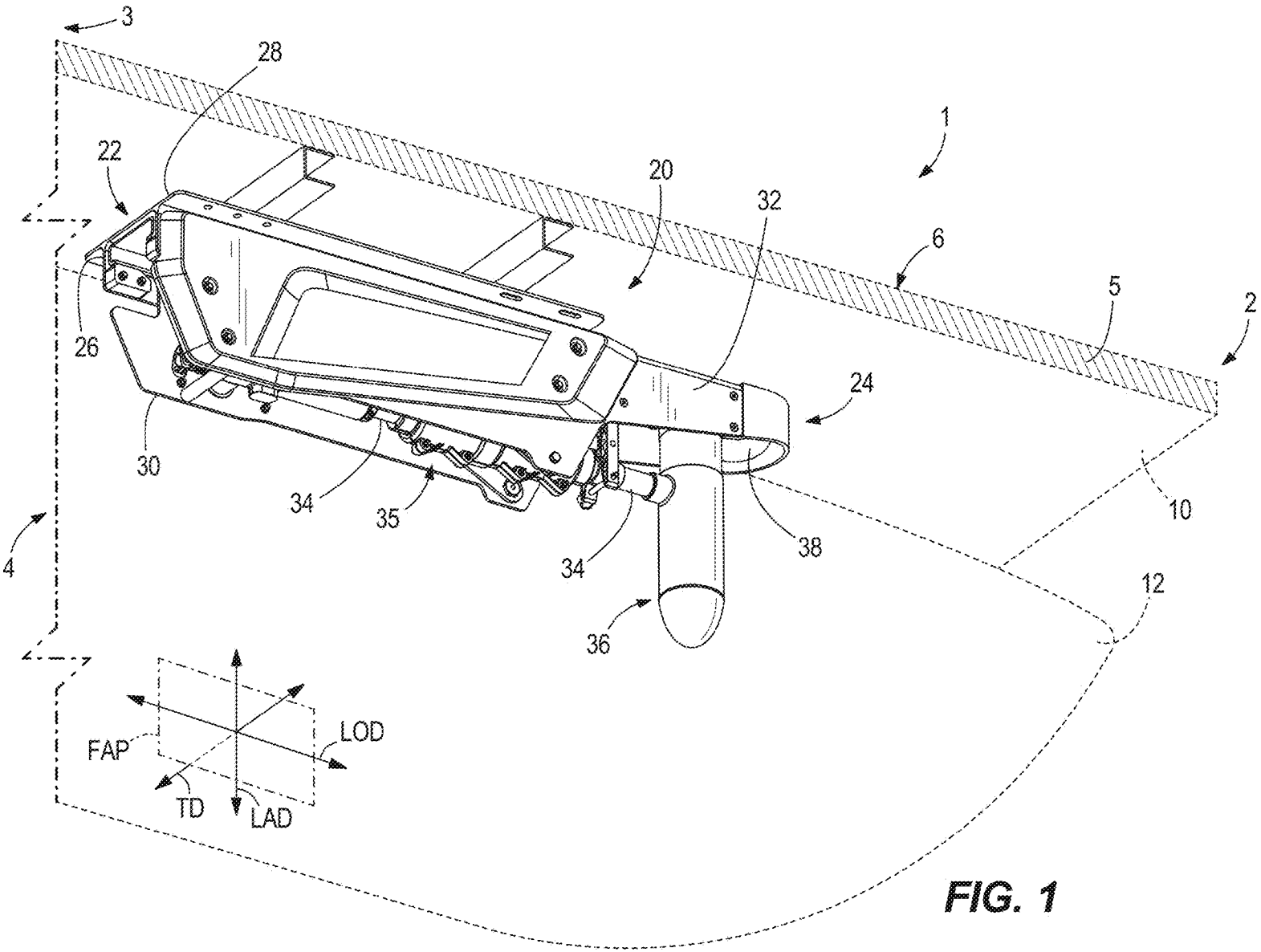
FIG. 1 is a right perspective view of a device according to the present disclosure coupled to a marine vessel.

FIG. 1 depicts the underside of a marine vessel 1 that extends between a bow 2 and a stern 3 defining a longitudinal direction LOD therebetween, as well as between port 4 and starboard 5 sides defining a transverse direction TD therebetween. The transverse direction TD is perpendicular to the longitudinal direction LOD. A latitudinal direction LAD extends perpendicularly to both the longitudinal direction LOD and the transverse direction TD. The longitudinal direction LOD and latitudinal direction LAD form a fore-aft plan FAP that bisects the marine vessel 1 between the port 4 and starboard 5 sides from the bow 2 to the stern 3.

The marine vessel 1 includes a deck 6 with pontoons 12 mounted to an underside 10 of the deck 6 in a customary manner. A stowable propulsion device according to the present disclosure, also referred to as a device 20, is coupled to the underside 10 of the deck 6, for example between the pontoons 12. The device 20 includes a base 22 that extends between a front 24 and a back 26, a top 28 and a bottom 30, and sides 32. Openings 130 (FIG. 2) are defined within the sides 32, in certain examples entirely therethrough, which are discussed further below. FIG. 1 further shows the top 28 of the base 22 being coupled to the marine vessel 1, for example using fasteners such as bolts or screws. The device 20 includes a propulsor 36 configured to propel the marine vessel 1 in water when in a deployed position (e.g., FIG. 6), for example via an electric motor rotating a propeller 38 in a customary manner. Additional information regarding the base 22 and propulsor 36 is provided in U.S. patent application Ser. No. 17/185,289.

Figure 2:
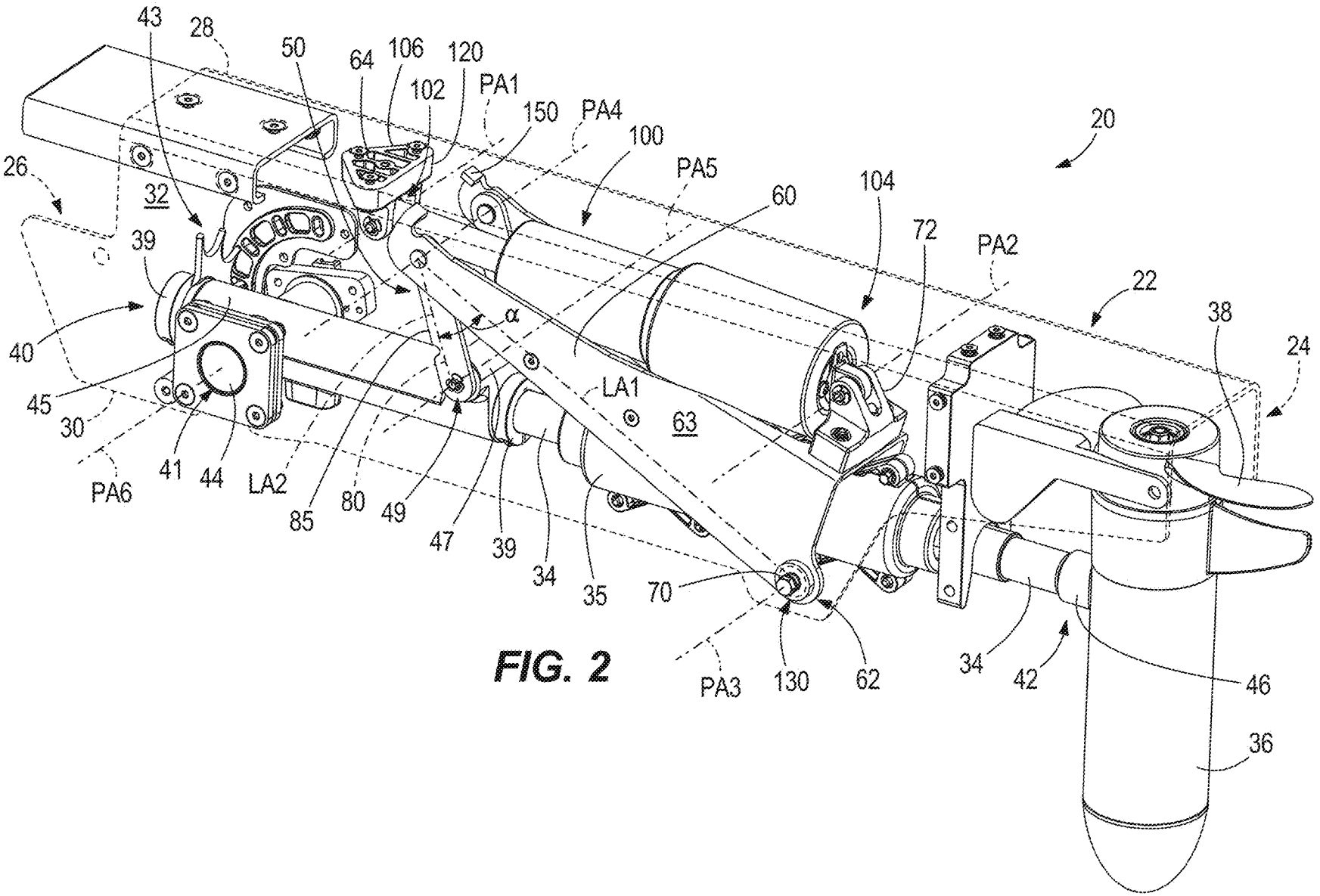
FIG. 2 is a right perspective view showing the inside of the device of FIG. 1 separate from the marine vessel.

FIG. 2 shows the device 20 of FIG. 1 with the base 22 in dashed lines to reveal the interior. The device 20 has an arm 34 that extends between a first end 40 and an opposite second end 42 defining a length therebetween. The arm 34 may be formed by multiple segments connected together, such as shown here coupled together by a shock absorbing coupler 35, for example. The arm 34 is pivotably coupled to the base 22 via an axle 44 that extends between the sides 32 of the base 22 (in this example supported by bearings 41 coupled to the inside surface of the sides 32). The axle 44 may be formed as extensions from the arm 34 (e.g., a casted part having a "t" shape), may be a separate element extending through an opening defined through the arm 34, or may be formed by two segments coupled to the arm 34 via a t-joint coupler 45 as shown, for example. Additional information regarding the axle 44 is provided in U.S. patent application Ser. No. 17/185,289.

In the example shown in FIG. 2, the arm 34 is pivotably coupled to the base 22 at a position between the first end 40 and the second end 42, and specifically closer to the first end 40 than to the second end 42. An optional gearset 43 is also provided, which provides for rotation of the arm 34 about its length between the first end 40 and second end 42 as the arm 34 is pivoted about the axle 44. Additional information regarding the gearset 43 and t-joint coupler 45 are provided in U.S. patent application Ser. No. 17/185,289. The arm 34 is shown pivotally coupled to the base via a t-joint coupler 45, which receives the arm 34 therethrough. Clamps 39 encircle the arm 34 on either side of the t-joint coupler 45 to maintain the axial position of the t-joint coupler 45 relative to the arm 34, while still allowing the arm 34 to rotate about its length within the t-joint coupler 45. In addition to the t-joint coupler 45 receiving or otherwise engaging with the axle 44 (which as stated above may be formed as two separate segments, for example), the t-joint coupler 45 includes a barrel 47 with an opening 49. The opening 49 extends parallel to the length of the axle 44. The barrel 47 pivots with t-joint coupler 45 about the axle 44 and does not rotate with the arm 34 along the length thereof. In this manner, the opening 49 in the barrel 47 provides a location for coupling an actuator to the arm 34 via the t-joint coupler 45, as discussed further below.

With continued reference to FIG. 2, the arm 34 is coupled to the propulsor 36, here with the second end 42 coupled to a collar 46 of the body of the propulsor 36 in a manner known in the art. The propulsor 36 is shown in FIG. 2 in a stowed position, but is moveable into and between the stowed position and a deployed position (see e.g., FIGS. 6-7) by pivoting the arm 34. It should be recognized that the propulsor 36 is relatively distal from the marine vessel 1 when in the deployed position as compared to the stowed position.

Figure 3:
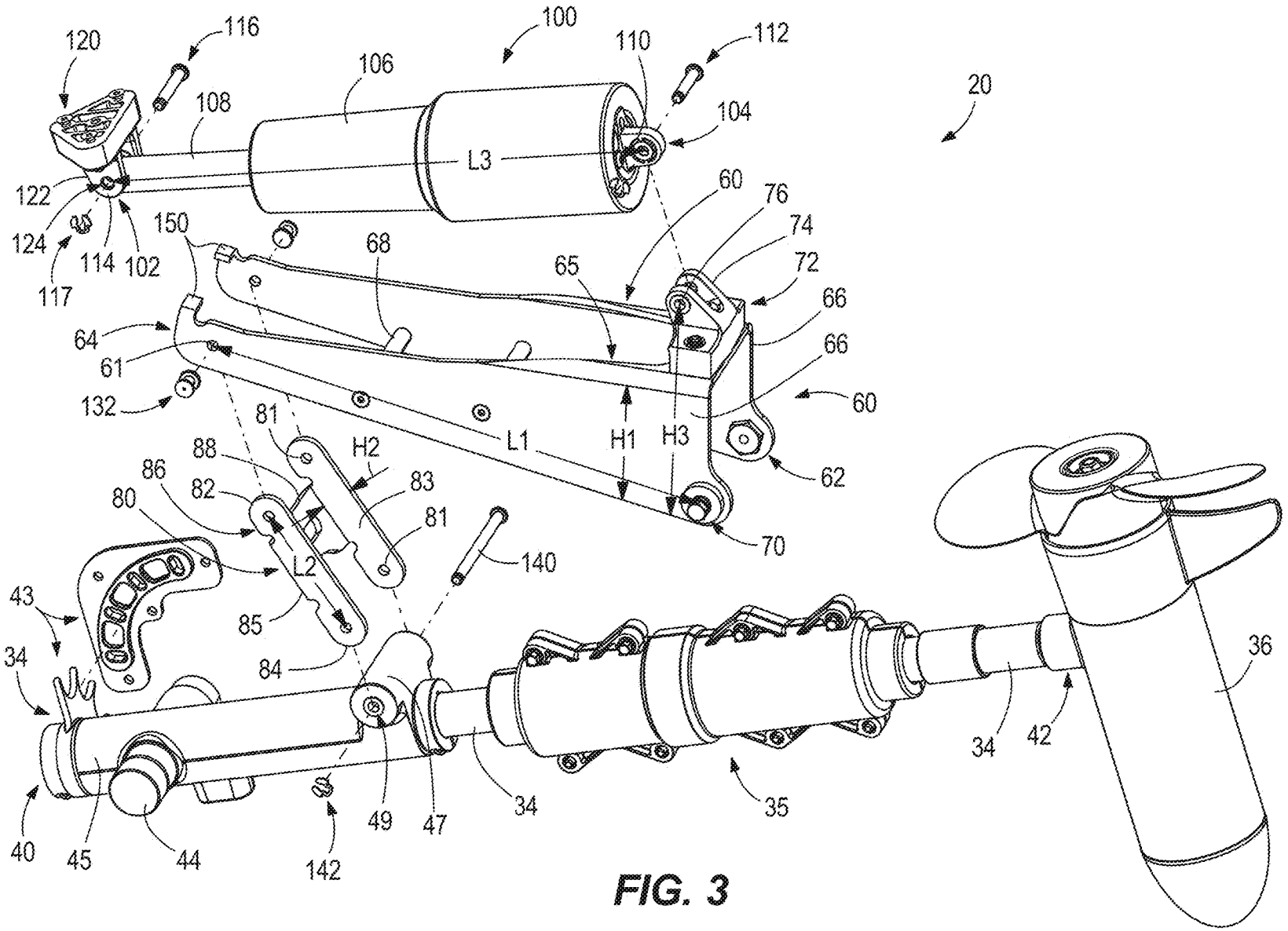
FIG. 3 is an exploded view of the device of FIG. 2.

As shown in FIG. 3, the arm 34 may be pivoted into and between the stowed and deployed positions via an actuator 100, shown here to be a linear actuator of a type presently known in the art. The actuator 100 has a cylinder 106 that receives a rod 108 therein. The actuator 100 may be actuated hydraulically, pneumatically, and/or electro-mechanically to extend and retract the rod 108 within the cylinder 106, thereby changing a distance between a first end 102 and a second end 104 of the actuator 100. An opening 110 is defined at or near the second end 104 of the actuator, and likewise an opening 114 defined through the rod 108 at or near the first end 102 of the actuator. The openings 110, 114 are configured to receive fasteners 112, 116 therein, such as pins or bolts, for example, for coupling the actuator 100 to other elements. A length L3 is defined between the openings 110, 114, which changes with actuation of the actuator 100 as described above. The length L3 may also generally be used to represent the distance between the first end 102 and the second end 104 of the actuator 100 (having a known offset to the openings 110, 114).

As shown in FIGS. 2-3, the first end 102 of the actuator 100 is pivotally coupled to the base 22 (to pivot about a first pivot axis PA1, FIG. 2) via a clevis 120. The clevis 120 is coupled to the top 28 of the base 22 via fasteners in a manner known in the art. Two fingers 122 of the clevis 120 extend downwardly away from the base 22, each defining an opening 124 therethrough. The first end 102 of the actuator 100 is pivotally coupled to the clevis 120 by extending the fastener 116 (e.g., a pin or bolt) through the opening 114 in the rod 108, and also through the openings 124 in the clevis. The fastener 116 is retained in place by engagement with a lock clip 117 (also referred to as a "C" clip), though other techniques such as cotter pins, threaded nuts (with corresponding threads on the fastener 116), and/or press-fit arrangements are also contemplated by the present disclosure, for example.

The present inventors have experimented with coupling the second end 104 of the actuator 100 to the arm 34 at a position between the first end 40 of the arm 34 and the axle 44. However, the inventors have recognized that this configuration results in great strain for the actuator 100, as discussed above. To this end, the present inventors have developed additional configurations for devices 20 as disclosed herein, which provide for increased mechanical advantage for the actuator 100, along with other performance improvements as discussed herein.

The device 20 of FIGS. 2-3 includes an actuator linkage 50 for coupling the actuator 100 to the arm 34 to provide pivoting thereof about the axle 44. The actuator linkage 50 includes a first link 60 that extends between a first end 62 and a second end 64 defining a length therebetween. In the example shown, the first link 60 is formed by two separate arms 66 connected by one or more members 68 therebetween in a manner known in the art. In the example shown, the arms 66 are parallel to each other. However, it should be recognized that the first link 60 (and likewise, the second link 80 discussed below) may have any number of individual arms 66, 86. It should further be recognized that using singular terms or using plural terms throughout the present disclosure is not limiting on how many arms 66, 86 the first link 60 and/or second link 80 have, respectively.

The first link 60 has sides 63 with heights H1 that extends between a top and bottom thereof, which may vary between the first end 62 and the second end 64. One or more top members 65 extends perpendicularly from the tops of the sides 63, which may also connect the arms 66 and is discussed further below. A clevis 72 is coupled to the first link 60, specifically to the top member 65 between the arms 66, such that the clevis 72 is positioned between the sides 63. The clevis 72 has two fingers 74 extending away from the top of the first link 60 with openings 76 defined therein.

As shown in FIGS. 2-3, the second end 104 of the actuator 100 is pivotally coupled to the actuator linkage 50, and specifically the first link 60 thereof, by inserting the fastener 112 through the openings 110, 76 in the actuator 100 and clevis 72, respectively. By way of example, FIG. 3 shows the fastener 112 being retained in place via a press-fit engagement with the opening 76 in the clevis 72 (e.g., with a nylon insert sandwiched therebetween within the opening 76). In this manner, the actuator 100 is pivotally coupled to the first link 60 to pivot about a second pivot axis PA2 (FIG. 2) formed by the fastener 112.

With continued reference to FIGS. 2-3, projections 70 (e.g., studs) extend away from the sides 63 near the first end 62, which may be integrally formed therewith or subsequently coupled via fasteners, welding, adhesives, or other methods known in the art. Openings 61 are also defined through the first link 60 near the second end 64. A length L1 is defined between the opening 61 and the projection 70 of the first link 60. In certain embodiments, projections 70 may also or alternatively be provided near the second end 64, and likewise openings 61 may also or alternatively be provided near the first end 62 to provide the same functions stated below.

The first link 60 is pivotally coupled to the base 22 (to pivot about a third pivot axis PA3, FIG. 2) by the projections 70 extending from the sides 63 of the first link 60 extending into the openings 130 in the sides 32 of the base 22. It should be recognized that the first link 60 may be pivotally coupled by other methods, including bolts or other fasteners with corresponding nuts engaged from the outside of the sides 32, for example. Additionally, bushings and/or washers (e.g., made of Delron or nylon) may be provided with the projections 70 to reduce friction and wear between the first link 60 and the base 22, for example. It should be recognized that such bushings and/or washers may also or alternatively be used in conjunction with the fasteners and mounting hardware of any joint throughout the disclosed device 20.

Figure 5:
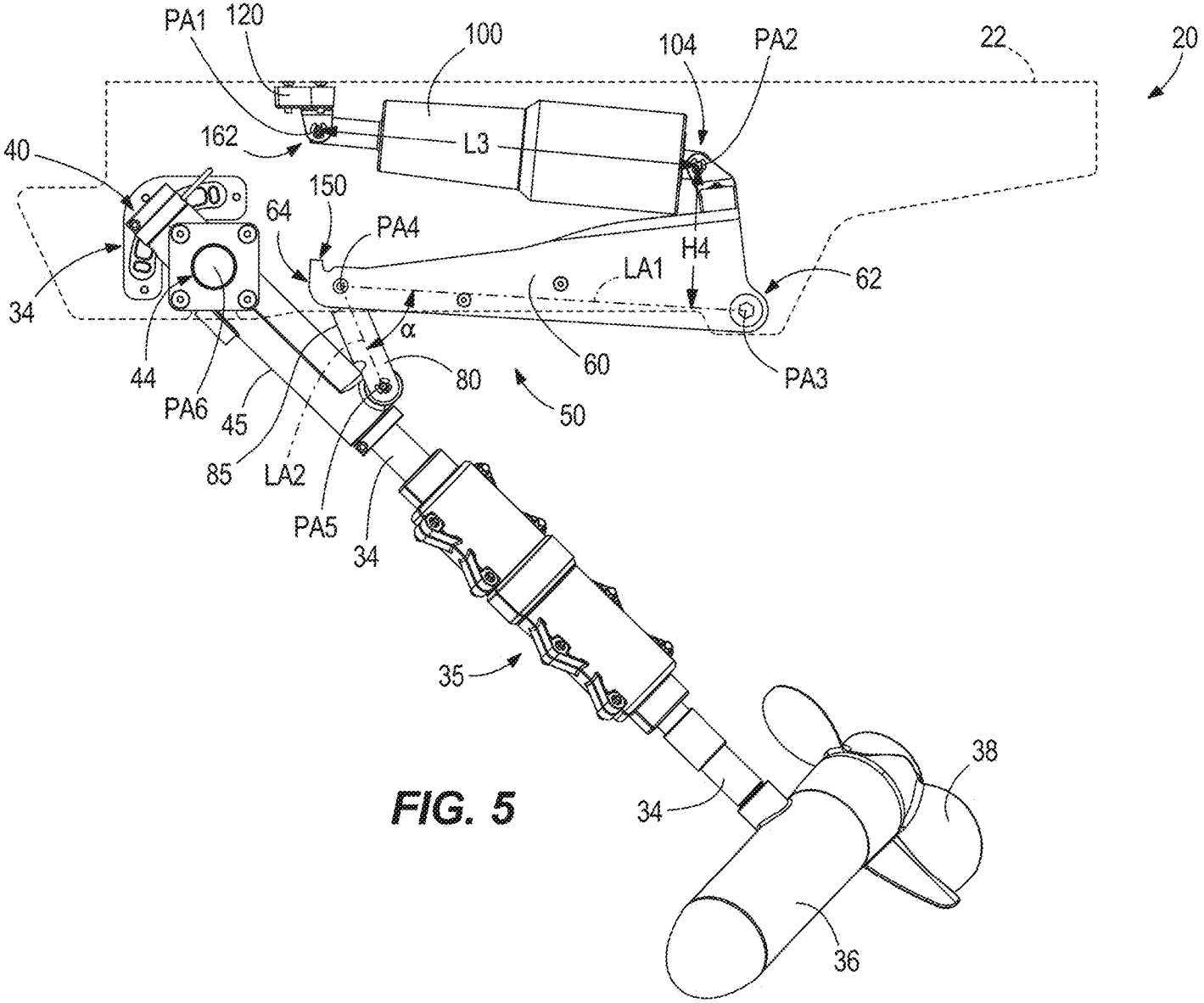
FIG. 5 is a right view of the device of FIG. 4 in an intermediate position between the stowed position and a deployed position.

In certain configurations (such as shown in FIG. 5), the present inventors have found that offsetting the second pivot axis PA2 and the third pivot axis PA3 (this offset being shown as H4) provides additional mechanical advantage by increasing the leverage provided to the actuator 100.

Returning to FIGS. 2-3, the actuator linkage 50 further includes a second link 80 that extends between a first end 82 and a second end 84 defining a length therebetween. In the example shown, the second link 80 is also formed by two separate arms 86 connected by one or more members 88 in a manner known in the art. In the example shown, the arms 86 are parallel to each other. The second link 80 has sides 83 with heights H2 that extends between a top 85 (FIG. 3) and bottom thereof, which may vary between the first end 82 and the second end 84. Openings 81 are defined through the second link 80 near the first end 82 and also near the second end 84. A length L2 is defined between the openings 81.

The second end 64 of the first link 60 is pivotally coupled to the first end 82 of the second link 80 to pivot about a fourth pivot axis PA4. In the example shown, a fastener 132 extends through the openings 61, 81 in the first link 60 and the second link 80, which is shown here as a rivet for each of the individual arms 66, 86, for example. Other types of fasteners 132 are also contemplated, including a pin with corresponding cotter pin, threaded bolt and corresponding nut, or other fasteners known in the art.

With continued reference to FIGS. 2-3, the second end 84 of the second link 80 is pivotally coupled to the arm 34 to pivot about a fifth pivot axis PA5, here at the t-joint coupler 45. In particular, a fastener 140 extends through the opening 81 in the second link 80 and also through the opening 49 defined in the barrel 47 of the t-joint coupler 45, whereby the fastener 140 engages with corresponding fastener 142 to remain in place. In the example shown, the fasteners 140, 142 are a pin and a corresponding a lock clip, respectively, similar to that shown for the second pivot axis PA2. However, other types of fasteners are also contemplated by the present disclosure (e.g., a nut and a bolt).

Figure 4:
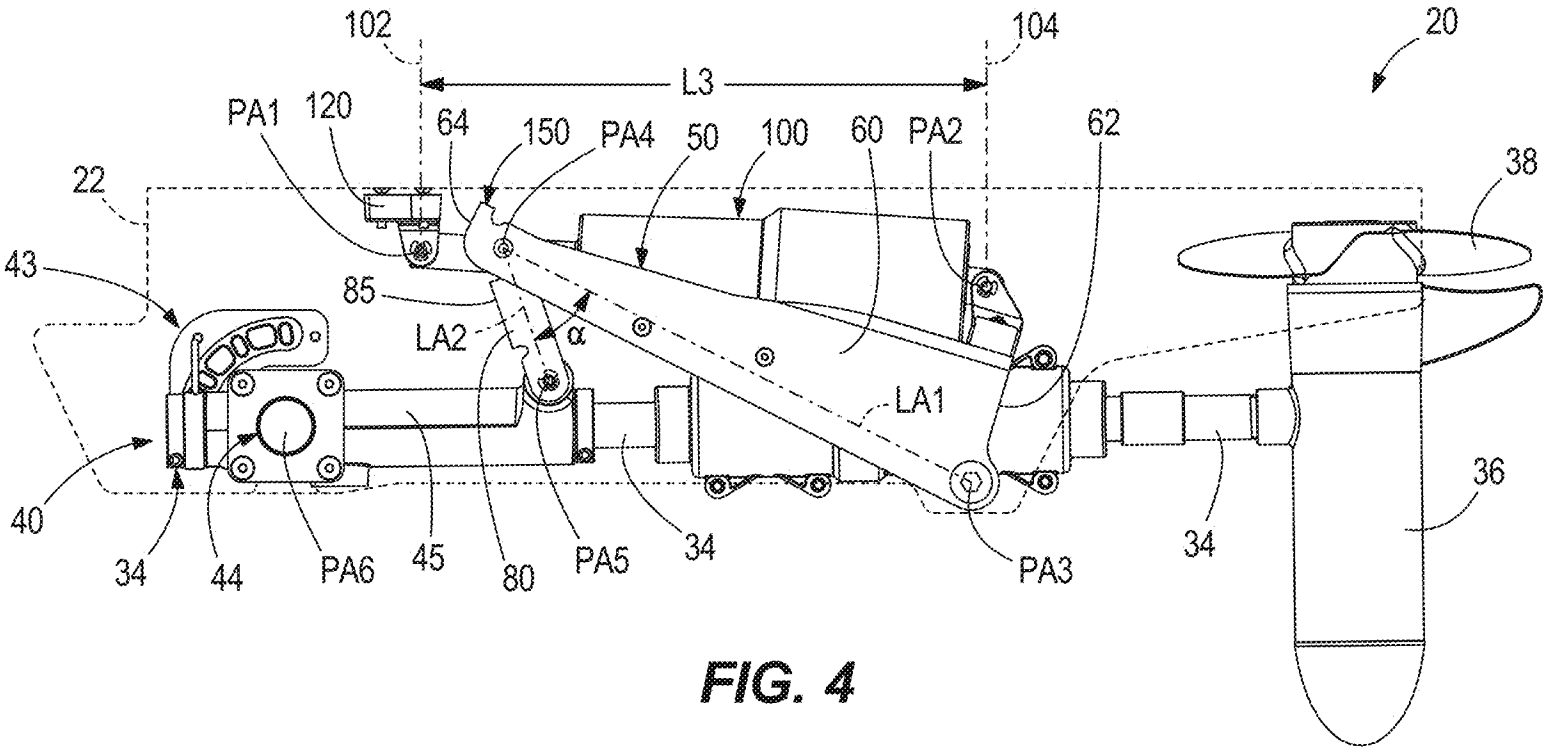
FIG. 4 is a right view of a device according to the present disclosure in a stowed position.

FIGS. 2-3 further show a configuration of device 20 having a stop 150 that limits how far the first link 60 may pivot relative to the second link 80 (limiting rotation about the fourth pivot axis PA4). In the example shown, the stop 150 is coupled to the first link 60 (which may be provided via integral formation, bending, welding, fasteners, or other methods known in the art). The stop 150 may alternatively be coupled to the second link 80 or the base 22 to the provide the same function. As shown in FIGS. 2 and 4, an angle $\alpha$ is defined between a first linear axis LA1 extending between the third pivot axis PA3 and the fourth pivot axis PA4, and between a second linear axis LA2 extending between the fourth pivot axis PA4 and the fifth pivot axis PA5. In this example, the stop 150 is two stops 150 formed by two separate tabs that extend perpendicularly inwardly from the tops of the arms 66 of the first link 60, here near the second end 64. By extending perpendicularly inwardly, the stops 150 are positioned to (at a certain angle $\alpha$) engage the tops 85 of the arms 86 forming the second link 80 to prevent further rotation, as discussed further below.

Figure 6:
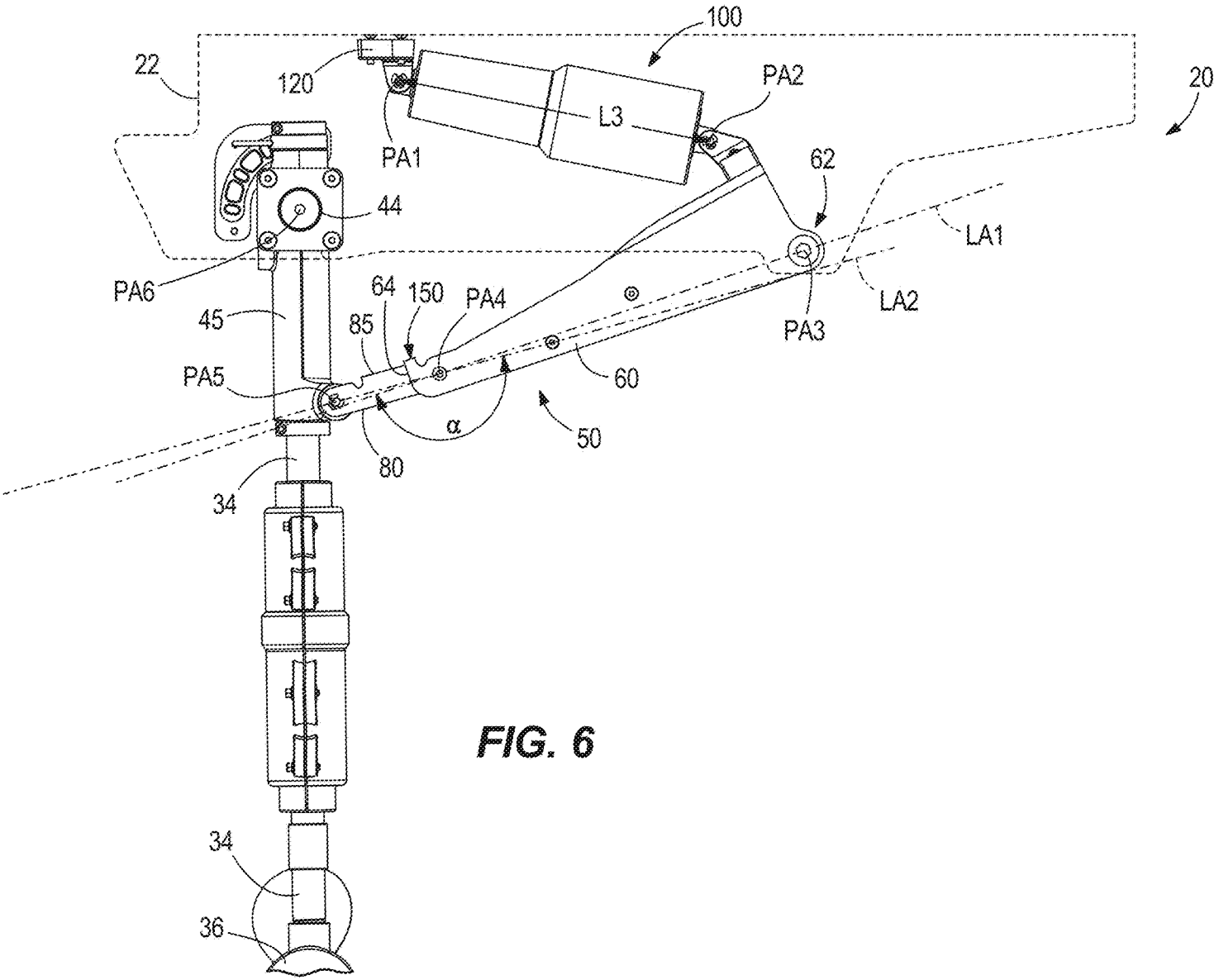
FIG. 6 is a right view of the device of FIG. 4 in the deployed position.
Figure 7:
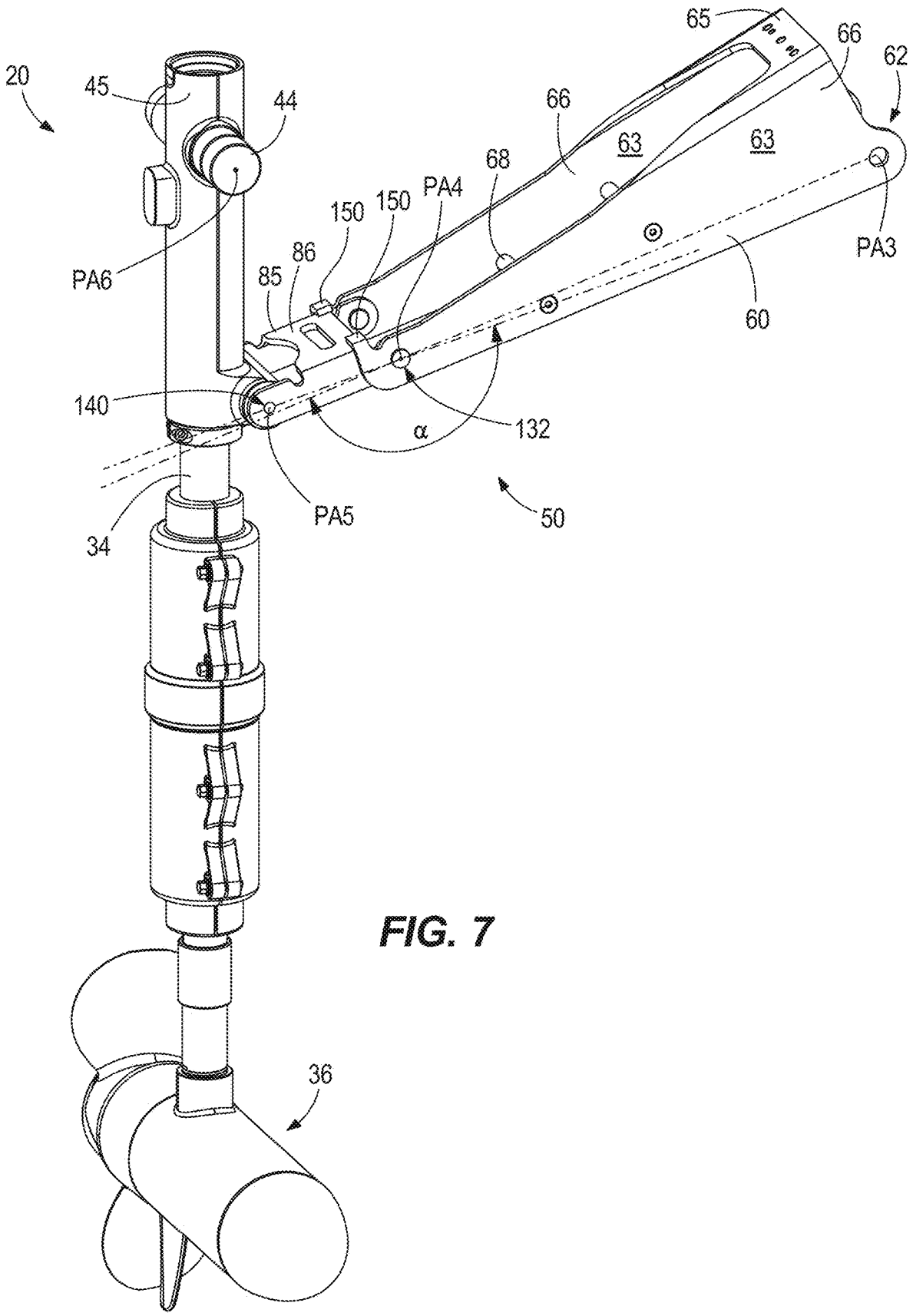
FIG. 7 is a right perspective view of the device of FIG. 6 in the deployed position.

FIGS. 4-7 depict the progression of the device 20 pivoting the arm 34 from the stowed position (FIG. 4) to the deployed position (FIGS. 6-7). In the configuration shown, retraction of the actuator 100 (reducing the length L3 between the first end 102 and the second end 104) causes the actuator linkage 50 to cause the arm 34 to pivot about the axle 44 towards the deployed position. In particular, the actuator 100 causes the first link 60 to pivot about the third pivot axis PA3 (here, counter-clockwise) such that the second end 64 of the first link 60 moves downwardly, away from the base 22. The process is assisting by gravity, which provides a constant downward force on the mass of the actuator linkage 50 itself, as well as on the masses of the actuator 100 and the propulsor 36 coupled to the actuator linkage 50. It should be recognized that the actuator 100 may positioned other than as shown, including being positioned such that extension (rather than retraction) causes rotation of the arm 34 towards the deployed position. However, the present inventors have identified that the configuration shown is advantageously compact when in the stowed position, providing a smaller package for installation, less drag in the water, and improved clearance for trailering the marine vessel.

With continued reference to FIGS. 4-7, rotation of the first link 60 allows the arm 34 to pivot downwardly towards the deployed position (here, clockwise about the axle 44), supported by the second link 80 connecting to the first link 60. For the configuration shown, the angle $\alpha$ between the first linear axis LA1 extending between the third pivot axis PA3 and the fourth pivot axis PA4, and the second linear axis LA2 extending between the fourth pivot axis PA4 and the fifth pivot axis PA5, begins at less than 180 degrees (and here less than 90 degrees) when in the fully stowed position (FIG. 4). For example, the angle $\alpha$ may be 30 degrees, 45 degrees, or other angles below 180 degrees when in the stowed position. As the arm 34 pivots towards the deployed position, the angle $\alpha$ increases to be 180 degrees when the propulsor 36 is nearly in the deployed position (i.e., the arm 34 extends nearly vertically downwardly), Through experimentation and development, the inventors have discovered that it is advantageous to configure the actuator linkage 50 (and the device 20 more generally) such that the angle $\alpha$ is greater than 180 degrees when the propulsor 36 is in the fully deployed position (FIGS. 6-7). In particular, by configuring the actuator linkage 50 to be "over-center" (the angle $\alpha$ exceeding 180 degrees), any forces exerted on the propulsor 36 or arm 34 are transferred to the contact between the stops 150 and the second link 80, and thus cannot be transferred to the actuator 100. This effectively locks the system 20 in the deployed position until the actuator 100 moves the actuator linkage 50 in an opposite direction to pivot the propulsor 36 towards the stowed position.

Furthermore, the additional leverage provided by the first length L1 of the first link 60 and the second link L2 of the second link 80 (along with the relative points of pivoting between the first link 60, the second link 80, and the base 22) greatly increase the mechanical advantage of the system to reduce the strain on the actuator 100. This increases durability and reliability, while also improving performance and the control of movement for the arm 34.

By way of additional non-limiting examples, the present inventors have found particular advantage in devices 20 configured such that:

- retraction of the linear actuator moves the propulsor into the deployed position and extension of the linear actuator moves the propulsor into the stowed position;
- the arm is pivotally coupled to the base at a sixth pivot axis, and the second pivot axis is horizontally closer to the sixth pivot axis when the propulsor is in the deployed position than when the propulsor is in the stowed position;
- the arm is pivotally coupled to the base at a sixth pivot axis, and the propulsor is closer to the fifth pivot axis than to the sixth pivot axis;
- the fourth pivot axis is horizontally closer than the fifth pivot axis to the sixth pivot axis when in the stowed position, and the fifth pivot axis is horizontally closer than the fourth pivot axis to the sixth pivot axis when in the deployed position;
- the fifth pivot axis remains vertically below the fourth pivot axis while pivoting between the stowed and deployed positions;
- the third pivot axis is vertically above the fourth pivot axis when the propulsor is in the deployed position, and the fourth pivot axis is vertically above the third pivot axis when the propulsor is in the stowed position;
- the angle $\alpha$ between the first link and the second link is greater than 180 degrees but less than 210 when the propulsor is in the deployed position; and/or the angle α between the first link and the second link is less than 90 degrees when the propulsor is in the stowed position.

In this manner, the presently disclosed systems and methods improve upon the prior art with respect to moving the propulsor into and between the stowed and deployed positions, but also with respect to stability and durability when the propulsor is in the deployed position.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A stowable propulsion device for a marine vessel having a deck, the stowable propulsion device comprising:

a base configured to be coupled to the marine vessel below the deck thereof;

a propulsor configured to propel the marine vessel in water;

an arm that couples the propulsor to the base such that moving the arm moves the propulsor into and between a stowed position located proximate to the marine vessel and a deployed position located relatively distal from the marine vessel as compared to the stowed position, and such that moving the arm rotates the propulsor about the arm;

an actuator linkage comprising:

a first link movably coupled to the base; and a second link that movably couples the first link to the arm; and an actuator that moves the actuator linkage to thereby move the propulsor into and between the stowed position and the deployed position.

2. The stowable propulsion device according to claim 1, wherein the propulsor is rotated approximately 90 degrees about the arm between the stowed position and the deployed position.

3. The stowable propulsion device according to claim 1, wherein the marine vessel is a pontoon boat configured to float on the water via pontoons and the base is configured to be coupled between the pontoons.

4. The stowable propulsion device according to claim 1, wherein the arm is pivotally coupled to the base.

5. The stowable propulsion device according to claim 1, wherein the actuator comprises a linear actuator.

6. The stowable propulsion device according to claim 5, wherein extension of the linear actuator pivots the actuator linkage to move the propulsor toward the stowed position and retraction of the linear actuator pivots the actuator linkage to move the propulsor toward the deployed position.

7. The stowable propulsion device according to claim 1, further comprising a stop member that limits pivoting of the first link relative to the second link.

8. The stowable propulsion device according to claim 7, wherein the stop member is fixed relative to the first link.

9. The stowable propulsion device according to claim 7, wherein the stop member is configured to limit the pivoting when an angle between the first link and the second link is at least 180 degrees.

10. The stowable propulsion device according to claim 1, wherein the actuator pivots the second link via pivoting the first link.

11. The stowable propulsion device according to claim 1, wherein the first link pivots less than 180 relative to the second link when the propulsor moves between the stowed position and the deployed position.

12. The stowable propulsion device according to claim 1, wherein the base extends farther vertically downwardly than the actuator linkage from the marine vessel when the propulsor is in the stowed position to thereby protect the actuator linkage.

13. A stowable propulsion device for a marine vessel having a deck, the stowable propulsion device comprising:

a base configured to be coupled to the marine vessel below the deck thereof;

a propulsor configured to propel the marine vessel in water;

an arm that couples the propulsor to the base such that moving the arm moves the propulsor into and between a stowed position located proximate to the marine vessel and a deployed position located relatively distal from the marine vessel as compared to the stowed position;

an actuator linkage comprising:

a first link movably coupled to the base; and a second link that movably couples the first link to the arm; and an actuator that moves the actuator linkage to thereby move the propulsor into and between the stowed position and the deployed position, wherein an axis in which the first link is pivotably coupled to the second link moves vertically towards the base when the propulsor moves towards the stowed position.

14. The stowable propulsion device according to claim 13, wherein the axis is vertically between the arm and the marine vessel when the propulsor is in the stowed position.

15. The stowable propulsion device according to claim 13, wherein the base extends farther vertically downwardly than the actuator linkage from the marine vessel when the propulsor is in the stowed position to thereby protect the actuator linkage.

16. The stowable propulsion device according to claim 13, wherein the actuator comprises a linear actuator configured such that extending the linear actuator moves the actuator linkage to move the propulsor toward the stowed position.

17. A stowable propulsion device for a marine vessel having a deck, the stowable propulsion device comprising:

a base configured to be coupled to the marine vessel below the deck thereof;

a propulsor configured to propel the marine vessel in water;

an arm that couples the propulsor to the base such that moving the arm moves the propulsor into and between a stowed position located proximate to the marine vessel and a deployed position located relatively distal from the marine vessel as compared to the stowed position;

an actuator linkage comprising:

a first link movably coupled to the base; and a second link that movably couples the first link to the arm; and a linear actuator that moves the actuator linkage to thereby move the propulsor into and between the stowed position and the deployed position, wherein extending the linear actuator moves the propulsor toward the stowed position.

18. The stowable propulsion device according to claim 17, wherein the first link pivots less than 180 relative to the second link when the propulsor moves between the stowed position and the deployed position.

19. The stowable propulsion device according to claim 17, further comprising a stop member that limits pivoting of the first link relative to the second link.

20. The stowable propulsion device according to claim 17, wherein when in the stowed position the propulsor extends farther vertically downwardly than the actuator linkage from the marine vessel.

* * * * *